US006874321B2

(12) United States Patent
Ogura

(10) Patent No.: US 6,874,321 B2
(45) Date of Patent: Apr. 5, 2005

(54) STIRLING ENGINE

(75) Inventor: Yoshiaki Ogura, Sakai (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/399,894

(22) PCT Filed: Oct. 19, 2001

(86) PCT No.: PCT/JP01/09232

§ 371 (c)(1),
(2), (4) Date: Oct. 20, 2003

(87) PCT Pub. No.: WO02/35159

PCT Pub. Date: May 2, 2002

(65) Prior Publication Data

US 2004/0050044 A1 Mar. 18, 2004

(30) Foreign Application Priority Data

Oct. 23, 2000 (JP) ..... 2000-322624

(51) Int. Cl.[7] ..... F02G 1/04; F01B 29/10; F25B 9/14

(52) U.S. Cl. ..... 60/520; 62/6

(58) Field of Search ..... 60/517, 520; 62/6

(56) References Cited

U.S. PATENT DOCUMENTS 5,461,859 A * 10/1995 Beale et al. ..... 60/517

6,694,730 B2 * 2/2004 O'Baid et al. ..... 60/520

FOREIGN PATENT DOCUMENTS

| | | |
|---|---|---|
| JP | 60-43157 A | 3/1985 |
| JP | 3-121244 A | 5/1991 |
| JP | 2000-39222 A | 2/2000 |

* cited by examiner

*Primary Examiner*—Sheldon J Richter
(74) *Attorney, Agent, or Firm*—Birch, Stewart, Kolasch & Birch, LLP

(57) ABSTRACT

A free-piston type Stirling engine used for producing cold heat with the vibration center position of a piston accurately kept. A first space is formed on one side of a piston, and a second space is formed on the opposite side to spread up to a portion adjacent to a cylinder's side wall. A piston is provided with a vibration-direction first groove extending up to the first space and a circumferential-direction second groove, and a cylinder is provided with a hole penetrating the side wall thereof. The second groove of the piston, when coupled with the cylinder's hole during a piston vibration process, allows the first space to communicate with the second space. Accordingly, a short-time communication between the first and second spaces will balance pressures in the two spaces against each other to keep the vibration center position of the piston accurately.

10 Claims, 9 Drawing Sheets

STIRLING ENGINE

TECHNICAL FIELD

The present invention relates to a Stirling-cycle engine used to produce cold (cryogenic heat), and more particularly to a Stirling-cycle engine that can precisely maintain the center position of the reciprocating movement of the piston thereof.

BACKGROUND ART

A free-piston-type Stirling-cycle engine designed for the production of cold is also called a reversed-Stirling-cycle engine in terms of the thermodynamic cycle on which it is based. FIG. 10 shows a sectional view of a conventional Stirling-cycle engine. A typical Stirling-cycle engine has a piston 1 and a displacer 2 that reciprocate linearly inside a cylinder 3. The piston 1 and the displacer 2 are arranged coaxially, and a rod 2*a* formed on the displacer 2 penetrates the piston 1 through a slide hole 1*a* formed at its center. Thus, the piston 1 and the displacer 2 are smoothly slidable along the cylinder inner slide surface 3*a*. Moreover, the piston 1 and the displacer 2 are resiliently supported on a pressure vessel 4 by a piston support spring 5 and a displacer support spring 6 respectively.

The space formed by the cylinder 3 is divided into two spaces by the piston 1. One of these spaces is a working space (a first and a third spaces) 7 located on that side of the piston 1 which faces the displacer 2, and the other is a back space (a second space) 8 located on that side of the piston 1 which faces away from the displacer 2. These spaces are filled with a working medium such as helium gas. The piston 1 is made to reciprocate with a predetermined period by an piston driving member, not shown, such as a linear motor. Thus, the working medium is compressed or expanded in the working space 7. The displacer 2 is made to reciprocate linearly by the change in the pressure of the working medium compressed or expanded in the working space 7. Here, the piston 1 and the displacer 2 are typically so designed as to reciprocate with the same period but with a 90°.

The working space 7 is further divided into two spaces by the displacer 2. One of these spaces is the first space 7*a* located between the piston 1 and the displacer 2, and the other is the third space 7*b* located at the tip of the cylinder 3. These two spaces are connected together through a regenerator 9, which is typically formed out of copper in the form of mesh. The working medium in the third space 7*b* produces cold at the tip, called the cold head, of the cylinder 3. The principles of the reversed Stirling thermodynamic cycle, as by what mechanism cold is produced here, are well known, and therefore no explanation will be given in these respects.

Between the cylinder slide surface 3*a* and the piston slide surface 1*b*, a sealing means, not shown, for shielding the first space 7*a* and the second space 8 from each other is provided. As the shielding means is typically used an inexpensive seal ring with a simple structure. However, owing to various factors, such as the influence of thermal expansion and the wear of the seal ring after a prolonged period of operation, perfect sealing is impossible here, and thus a very small gap appears between the cylinder slide surface 3*a* and the piston slide surface 1*b*. When the engine is driven, the piston 1 reciprocates and produces changes in the pressure of the working medium in the first space 7*a* and the second space 8. The resulting pressure difference between these spaces causes the working medium to flow from one of those spaces to the other through the aforementioned very small gap. Specifically, when the pressure in the first space 7*a* is higher than that in the second space 8, the working medium flows from the first space 7*a* to the second space 8; when the pressure in the second space 8 is higher than that in the first space 7*a*, the working medium flows from the second space 8 to the first space 7*a*.

The very small gap appearing between the cylinder slide surface 3*a* and the piston slide surface 1*b* is not constant but varies according to the surface conditions of the slide components and the contact, wear, and other conditions of the seal ring. Thus, the inflow volume and the outflow volume of the working medium to and from the second space 8 as seen from the first space 7*a* are not exactly equal. For this reason, when the engine is driven continuously and the working medium leaks little by little from the first space 7*a* to the second space 8, the center position of the piston 1, which has initially been set so that equilibrium of pressure is achieved between the first space 7*a* and the second space 8, gradually moves toward the first space 7*a*, where the pressure is lower now. As a result, as the pressure of the working medium in the first space 7*a* lowers, problems arise, such as lower cooling performance than expected, or collision between the piston 1 and the displacer 2 resulting from the center position of the reciprocating movement of the piston 1 being displaced from the initially set position.

These problems may be solved by increasing the spring constant of the piston support spring 5 so as to increase the force supporting the piston 1. This, however, is not at all effective against the leakage of the working medium out of the first space 7*a*, and only invites an increase in the power required by the driving means for driving the piston 1, leading to an increase in the input electric power. This leads to another problem, lower cooling efficiency.

To solve this problem, Japanese Patent Application Laid-Open No. 2000-39222 discloses a method of reducing the variation of the center position of the reciprocating movement of the piston 1 by maintaining the equilibrium of pressure between the first space 7*a* and the second space 8. FIG. 11A shows a sectional view of the Stirling-cycle engine disclosed in Japanese Patent Application Laid-Open No. 2000-39222. The structure here is the same as that shown in FIG. 10 except for the shape of part of the piston 1. FIG. 11B is a perspective view of a portion around the piston 1 when the piston 1 is in the center position of its reciprocating movement as initially set. In the piston 1 are formed a first groove 10*a* that connects to the first space and runs in the direction of the reciprocating movement X of the piston 1 and a second groove 10*b* that is continuous with the first groove 10*a* and runs at an angle (in the figure, 90°) to the direction of the reciprocating movement X of the piston 1. In the cylinder 3 is formed a circular hole 12 that penetrates from the second groove 10*b* to the second space 8. The moment that the second groove 10*b* coincides with the circular hole 12 during the operation of the piston 1, the first space 7*a* and the second space 8 are momentarily connected together and permit the working medium to flow. This brings the pressure in those two spaces into equilibrium and thereby permits the piston 1 to reciprocate with the center position kept in the initially set position.

As described above, connecting the first space 7*a* and the second space 8 together by way of a minute flow passage when the piston 1 is in the center position of its reciprocating movement as initially set is effective in keeping the center position in the initially set position. However, to achieve higher cooling performance, it is necessary either to increase the number of cycles of the reciprocating movement of the piston 1 or to increase the amplitude of each cycle of the reciprocating movement of the piston 1. This inevitably increases the flow rate of the working medium between the first space 7*a* and the second space 8, and thus requires that the first and second grooves 10*a* and 10*b* have a larger cross-sectional area. Here, simply increasing the dimensions and cross-sectional area of the first and second grooves 10*a* and 10*b* makes the area over which the second groove 10*b* communicates with the second space 8 larger with respect to the working stroke of the piston 1, and also makes the time for which they communicate with each other longer.

Thus, it is possible to achieve equilibrium of pressure between the first space 7*a* and the second space 8, but it is not possible to keep the center position of the reciprocating movement of the piston 1 accurately in the initially set position. Moreover, a gas flow loss occurs in the first and second grooves 10*a* and 10*b*. This increases the input of power required to operate the piston 1, and thus makes it impossible to enhance the performance of the Stirling-cycle engine as expected.

DISCLOSURE OF THE INVENTION

An object of the present invention is to provide a Stirling-cycle engine in which the center position of the reciprocating movement of its piston is stabilized by forming grooves in the piston easily and cheaply. Another object of the present invention is to provide a Stirling-cycle engine with a reduced gas flow loss from the working space. Still another object of the present invention is to provide a Stirling-cycle engine in which the flow of the working medium does not spoil the smooth sliding of the piston achieved by an air bearing.

To achieve the above objects, according to the present invention, a Stirling-cycle engine is provided with a piston that reciprocates inside a cylinder and a displacer that reciprocates inside the cylinder as a result of a working medium being compressed or expanded by the reciprocating movement of the piston, and the piston and the displacer are arranged so that their center axes coincide with the center axis of the cylinder. Moreover, the stirling-cycle engine has a first space formed between the displacer and the piston, a second space formed so as to extend from the side of the piston facing away from the displacer and include a portion adjacent to at least part of the side wall of the cylinder, a third space formed on the side of the displacer facing away from the piston, a first groove formed so as to run from the end surface of the piston facing the first space in the direction of the reciprocating movement, and a second groove formed around the periphery of the piston so as to cross the first groove, and a hole formed through the side wall of the cylinder. This Stirling-cycle engine is so structured that, when the piston is in the center position of its reciprocating movement, the second groove and the hole connect to each other so that the first and second spaces communicate with each other. Here, the opening of the hole has the shape of an elongate circle or a rectangle having its minor axis or shorter sides aligned with the direction of the reciprocating movement of the piston. This helps shorten the time for which the second groove and the hole connect to each other during the reciprocating movement of the piston.

Alternatively, a Stirling-cycle engine is provided with a piston that reciprocates inside a cylinder and a displacer that reciprocates inside the cylinder as a result of a working medium being compressed or expanded by the reciprocating movement of the piston, and the piston and the displacer are arranged so that their center axes coincide with the center axis of the cylinder. Moreover, the Stirling-cycle engine has a first space formed between the displacer and the piston, a second space formed so as to extend from the side of the piston facing away from the displacer and include a portion adjacent to at least part of the side wall of the cylinder, a third space formed on the side of the displacer facing away from the piston, a first groove formed so as to run from the end surface of the piston facing the first space in the direction of the reciprocating movement, and a second groove formed around the periphery of the piston so as to cross the first groove, and a hole formed through the side wall of the cylinder. This Stirling-cycle engine is so structured that, when the piston is in the center position of its reciprocating movement, the second grove and the hole connect to each other so that the first and second spaces communicate with each other. Here, the hole consists of a plurality of such holes arranged along the second groove. This permits the second groove and the holes to connect to each other at different points on the second groove simultaneously during the reciprocating movement of the piston.

Here, the second groove may be so formed that its depth is greater than its width as viewed in a cross section. This helps reduce the time for which the second groove and the hole connect to each other during the reciprocating movement of the piston.

Alternatively, the first groove may be so formed that its depth is greater than its width as viewed in a cross section. This helps reduce the proportion of the area occupied by the first groove relative to the surface area of the slide surface of the piston.

Alternatively, the first groove may be given increasingly large cross-sectional areas from one end thereof toward the other end thereof so that the first groove has the maximum cross-sectional area at the other end thereof facing the first space. This helps reduce the energy loss due to the flow of working medium.

BEST MODE FOR CARRYING OUT THE INVENTION

Hereinafter, practical embodiments of the present invention will be described with reference to the drawings. All the embodiments described below have the same structure as that described earlier as a conventional example except for the structure of the piston and cylinder. Therefore, overlapping explanations will not be repeated, and descriptions will be given only of the structure of the piston and the cylinder with reference to the drawings. It is to be noted that, in the following descriptions, a single cylinder acts both as a cylinder (a first cylinder) provided with a piston and as a cylinder (a second cylinder) provided with a displacer, but that the first and second cylinders may be arranged in any other manner as long as the reciprocating movement of the piston inside the first cylinder compresses or expands the working medium and thereby causes the displacer to reciprocate inside the second cylinder.

Figure 1A:
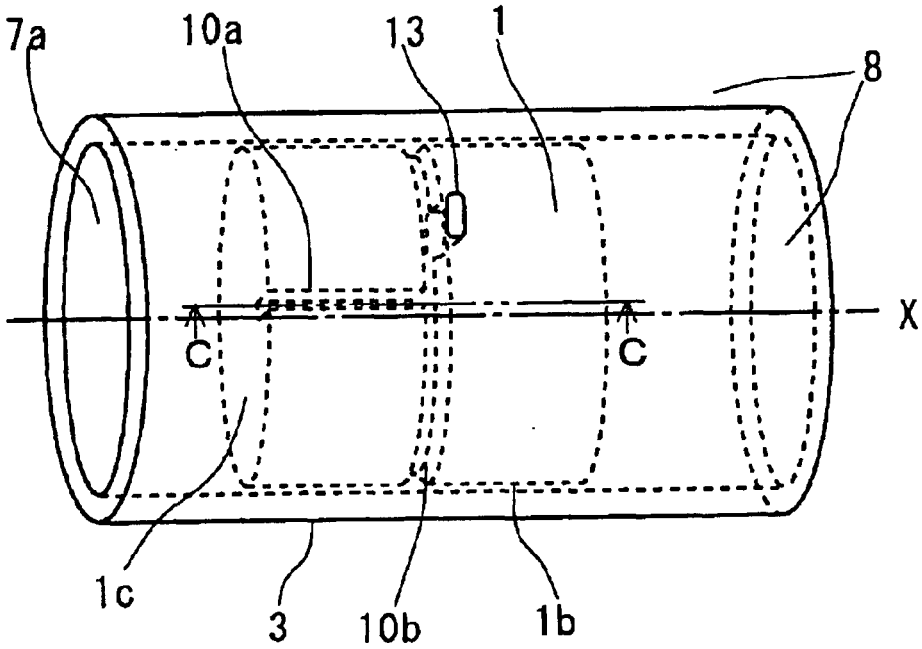
FIG. 1A is a perspective view of the piston and the cylinder of a first embodiment of the invention.

FIG. 1A is a perspective view of the piston and the cylinder of a first embodiment of the invention. Initially, the piston 1 is in the center position of its reciprocating movement where it is designed that equilibrium of pressure is achieved between the first space 7*a* and the second space 8. In the piston slide surface 1*b*, a first groove 10*a* is formed so as to run from the piston end surface 1*c* facing the first space 7*a* in the direction X of the reciprocating movement, and a second groove 10*b* is formed all around the periphery of the piston 1 so as to cross the first groove 10*a*. Moreover, in the cylinder 3, a hole 13 is formed so as to penetrate from the second groove 10*b* to the second space 8. Thus, during the reciprocating movement of the piston 1, only the moment that the second groove 10*b* and the hole 13 communicate with each other, the first space 7*a* and the second space 8 communicate with each other so that equilibrium of pressure is achieved between the first space 7*a* and the second space 8. Since the second groove 10*b* is formed all around the periphery of the piston 1, even if the piston 1 rotates about its axis while moving, the second groove lob can communicate with the hole 13.

Here, the opening of the hole 13 is formed in the shape of an elongate circle having its minor axis aligned with the direction X of the reciprocating movement, as one of shapes that make it possible to secure a cross-sectional area sufficient to achieve equilibrium of pressure between the first space 7*a* and the second space 8 while reducing the time for which those spaces communicate with each other when the piston 1 is driven to move. This reduces the time for which the second groove 10*b* and the hole 13 communicate with each other when the piston 1 is driven to move, and thus helps increase the accuracy of the center position of the movement of the piston 1. The opening of the hole 13 may be formed in any other shape as long as it helps shorten the time for which the second groove 10*b* and the hole 13 communicate with each other when the piston 1 is driven to move, for example a rectangle having its shorter sides aligned with the direction X of the reciprocating movement of the piston.

Figure 1B:
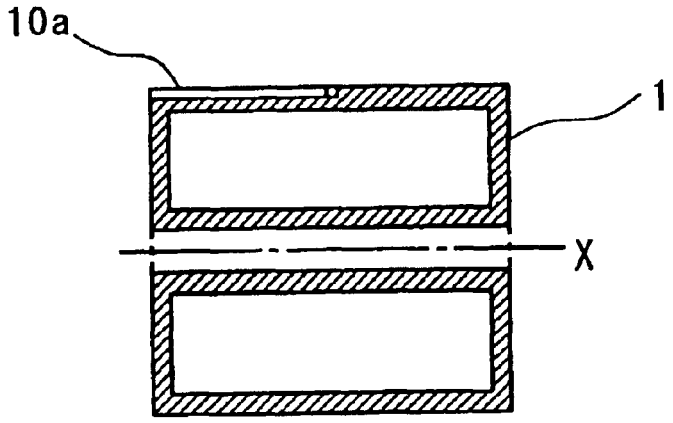
FIG. 1B is a sectional view taken along line C—C shown in FIG. 1A.

As shown in FIG. 1B, which is a sectional view taken along line C—C shown in FIG. 1A, the piston 1 is made hollow. This helps reduce the weight of the piston 1 and thereby make the design of the piston support spring 5 easier, and also helps reduce the amounts of materials used. To make the hollow portion of the piston 1 larger, it is advisable to make the depth of the first and second grooves 10*a* and 10*b* as small as possible. Making the piston 1 hollow in this way can be applied to all the embodiments of the invention to achieve the same effects.

Figure 2:
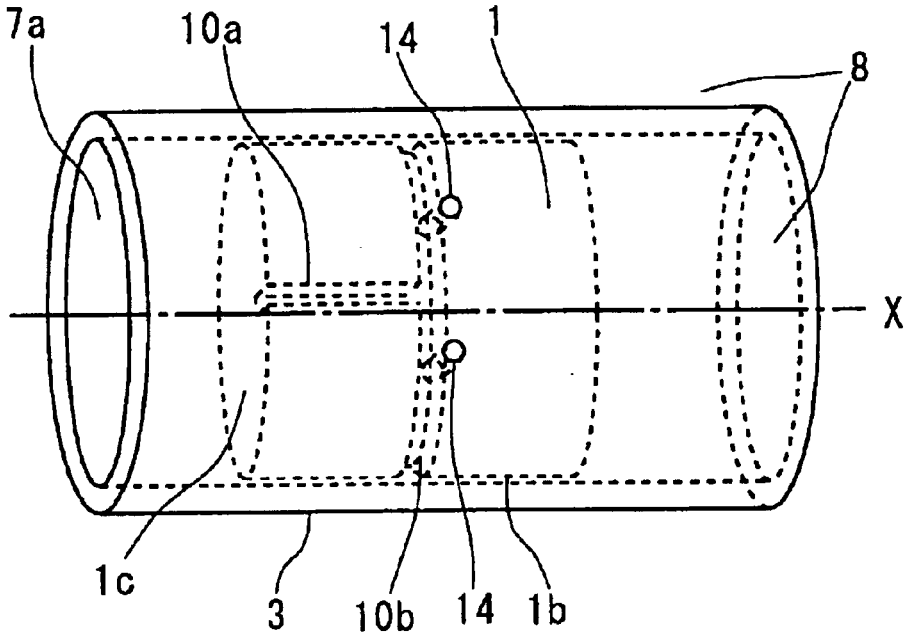
FIG. 2 is a perspective view of the piston and the cylinder of a second embodiment of the invention.

FIG. 2 is a perspective view of the piston and the cylinder of a second embodiment of the invention. The piston 1 is in the center position of its reciprocating movement as initially set. In the piston slide surface 1*b*, a first groove 10*a* is formed so as to run from the piston end surface 1*c* facing the first space 7*a* in the direction X of the reciprocating movement, and a second groove 10*b* is formed all around the periphery of the piston 1 so as to cross the first groove 10*a*. Moreover, in the cylinder 3, a plurality of (in FIG. 2, two) holes 14 are formed so as to penetrate from the second groove 10*b* to the second space 8. Since the second groove 10*b* is formed all around the periphery of the piston 1, even if the piston 1 rotates about its axis while moving, the second groove 10*b* can communicate with the hole 14.

Here, where a plurality of holes 14 are formed, by making the total of the diametrical cross-sectional areas of the holes 14 equal to the cross-sectional area of the single hole 14 in a case where only one hole 14 is formed, it is possible to make the individual holes 14 smaller and simultaneously make the cross-sectional area of the second groove 10*b* smaller. This helps shorten the time for which the second groove 10*b* and the holes 14 communicate with each other when the piston 1 is driven to move and thereby increase the accuracy of the center position of the movement of the piston 1. The opening of the holes 14 is formed in the shape of a circle, elongate circle, or rectangle.

Figure 3:
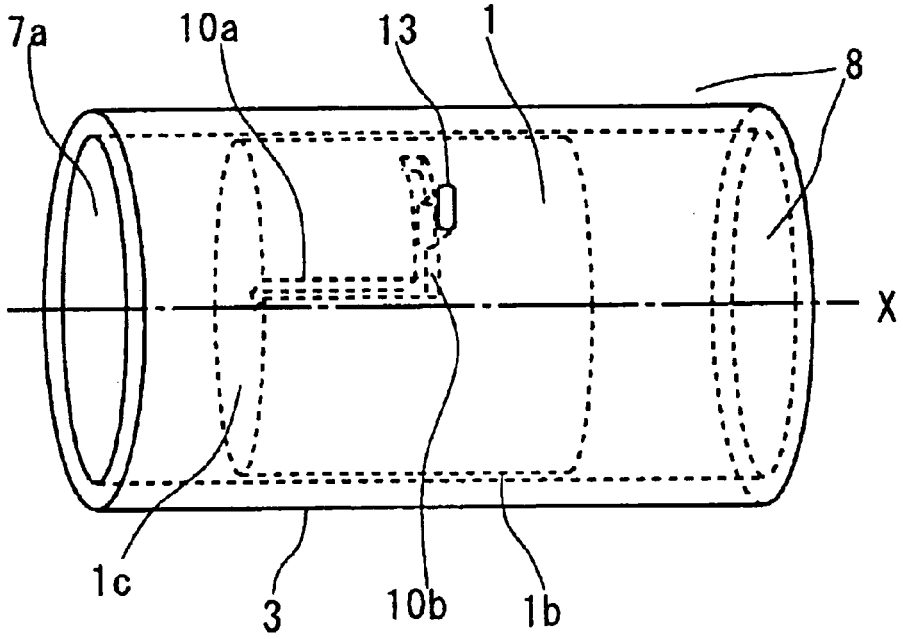
FIG. 3 is a perspective view of the piston and the cylinder of a third embodiment of the invention.
Figure 10:
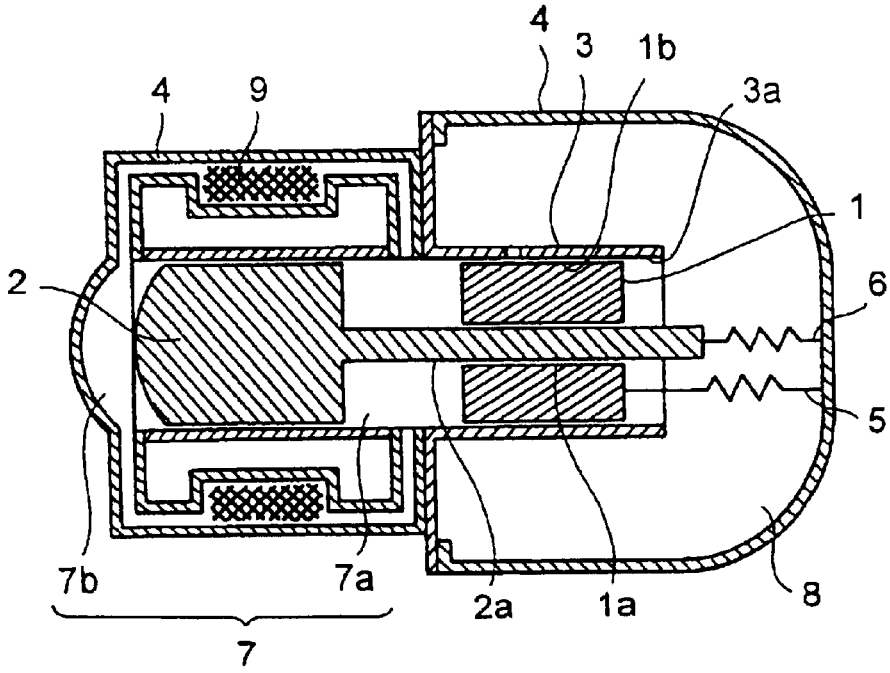
FIG.10 CONVENTIONAL ART
FIG. 10 is a sectional view of a conventional Stirling-cycle engine.
Figure 11A:
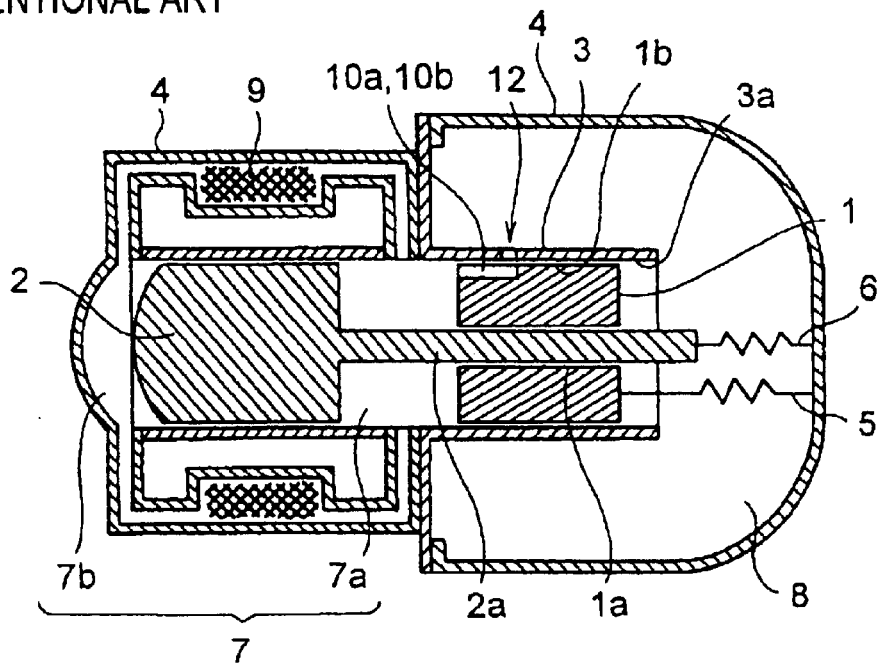
FIG.11A CONVENTIONAL ART
FIG. 11A is a sectional view of another conventional Stirling-cycle engine.
Figure 11B:
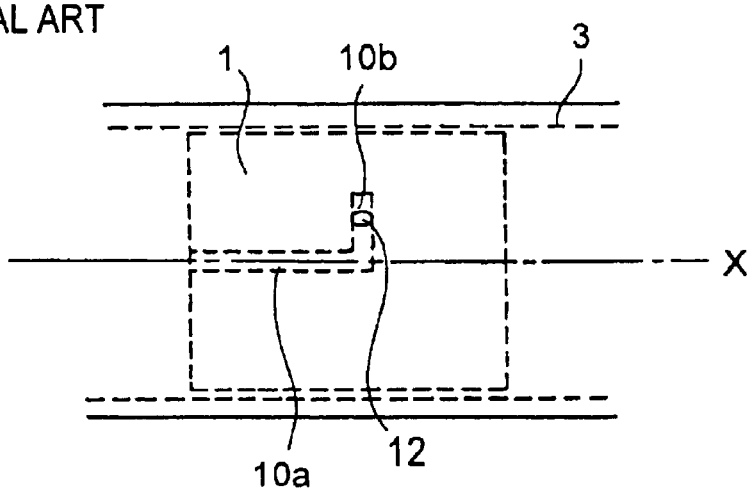
FIG.11B CONVENTIONAL ART
FIG. 11B is a perspective view showing a portion around the piston of the conventional Stirling-cycle engine.

FIG. 3 is a perspective view of the piston and the cylinder of a third embodiment of the invention. The piston 1 is in the center position of its reciprocating movement as set initially, and is provided with a means (for example the piston support spring 5 shown in FIG. 10) for restricting the rotation of the piston 1 about its axis. In the piston slide surface 1*b*, a first groove 10*a* is formed so as to run from the piston end surface 1*c* facing the first space 7*a* in the direction X of the reciprocating movement, and a second groove 10*b* is formed in the periphery of the piston 1 so as to extend from one point on the first groove perpendicularly to the first groove (in FIG. 3, L-shaped). The second groove 10*b* is formed only where the hole 13 and the second groove 10*b* communicate with each other through the shortest path, and the opening of the hole 13 is formed in the shape of an elongate circle. The opening of the hole 13 may formed in any other shape as long as it helps shorten the time for which the second groove 10*b* and the hole 13 communicate with each other when the piston 1 is driven to move, for example a rectangle.

Figure 4:
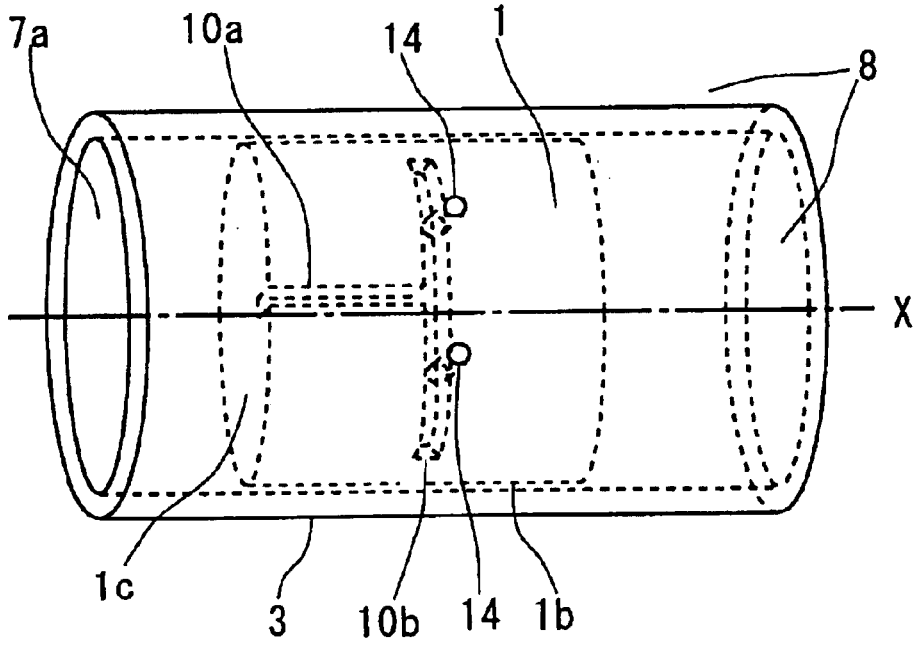
FIG. 4 is a perspective view of the piston and the cylinder of a fourth embodiment of the invention.

FIG. 4 is a perspective view of the piston and the cylinder of a fourth embodiment of the invention. The piston 1 is in the center position of its reciprocating movement as set initially, and is provided with a means (for example the piston support spring 5 shown in FIG. 10) for restricting the rotation of the piston 1 about its axis. In the piston slide surface 1*b*, a first groove 10*a* is formed so as to run from the piston end surface 1*c* facing the first space 7*a* in the direction X of the reciprocating movement, and a second groove 10*b* is formed in the periphery of the piston 1 so as to extend from one point on the first groove perpendicularly to the first groove (in FIG. 4, T-shaped). Moreover, in the second groove 10*b*, two or more holes 14 are formed, of which the opening is formed in the shape of a circle, elongate circle, or rectangle. The second groove 10*b* is formed only where the holes 14 communicate with the first groove 10*a* through the shortest path.

Figure 5:
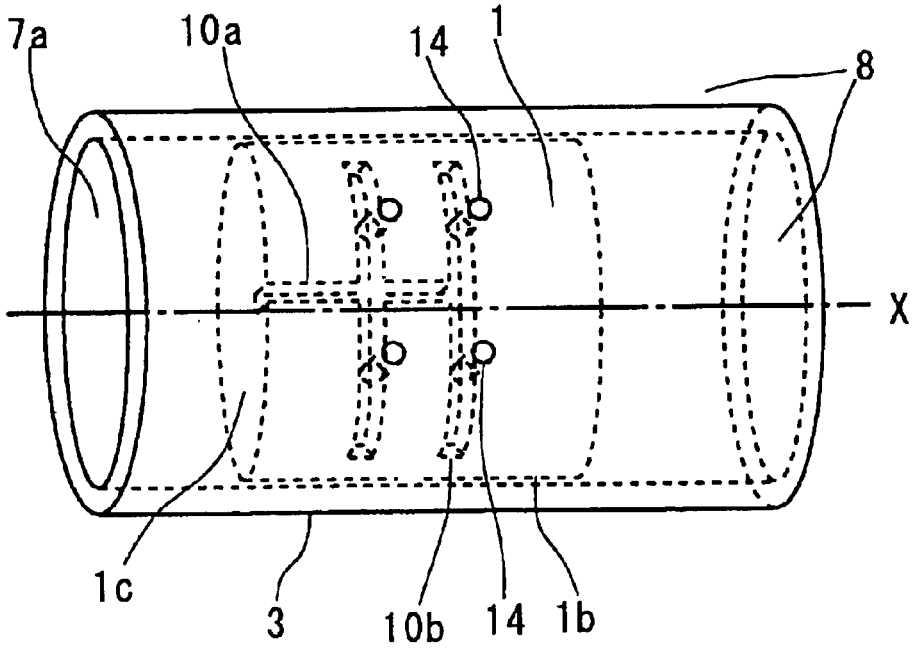
FIG. 5 is a perspective view of the piston and the cylinder of a fifth embodiment of the invention.

FIG. 5 is a perspective view of the piston and the cylinder of a fifth embodiment of the invention. The piston 1 is in the center position of its reciprocating movement as set initially, and is provided with a means (for example the piston support spring 5 shown in FIG. 10) for restricting the rotation of the piston 1 about its axis. In the piston slide surface 1*b,* a first groove 10*a* is formed so as to run from the piston end surface 1*c* facing the first space 7*a* in the direction X of the reciprocating movement, and a pair of second grooves 10*b* is formed in such a way that each branches off one point on the first groove in a fashion symmetric with respect to the first groove in the periphery of the piston 1. The two second grooves 10*b* are arranged along the first groove 10*a*. Moreover, in the cylinder 3, four holes 14 in total, i.e. two holes for each of the second grooves 10*b,* are formed. The opening of the holes 14 is formed in the shape of a circle, elongate circle, or rectangle. The second grooves 10*b* are formed only where the holes 14 communicate with the first groove 10*a* through the shortest path.

In the fourth and fifth embodiments of the invention, where a plurality of holes 14 are formed, by making the total of the diametrical cross-sectional areas of the holes 14 equal to the cross-sectional area of the single hole 14 in a case where only one hole 14 is formed, it is possible to make the individual holes 14 smaller and simultaneously make the cross-sectional area of the second groove 10*b* smaller. This helps shorten the time for which the second groove 10*b* and the holes 14 communicate with each other when the piston 1 is driven to move and thereby increase the accuracy of the center position of the movement of the piston 1.

Figure 6A:
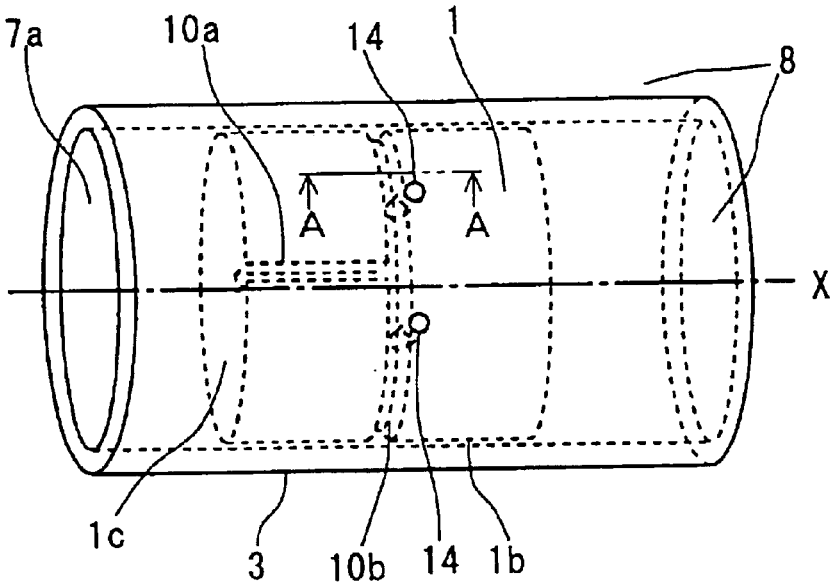
FIG. 6A is a perspective view of the piston and the cylinder of a sixth embodiment of the invention.
Figure 6B:
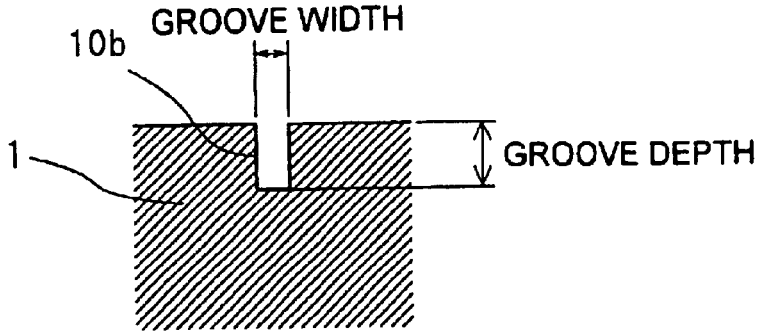
FIG. 6B is a sectional view taken along line A—A shown in FIG. 6A.

FIG. 6A is a perspective view of the piston and the cylinder of a sixth embodiment of the invention. Here, the piston 1, the first and second grooves 10*a* and 10*b,* and the holes 14 are arranged in the same manner as in the second embodiment. FIG. 6B is a sectional view taken along line A—A shown in FIG. 6A. The second groove 10*b* is so formed as to have a cross-sectional area required to permit the flow of the working medium and have a cross-sectional shape of which the depth is greater than the width. This helps shorten the time for which the second groove 10*b* and the holes 14 communicate with each other when the piston 1 is driven to move and thereby increase the accuracy of the center position of the movement of the piston 1.

Figure 7A:
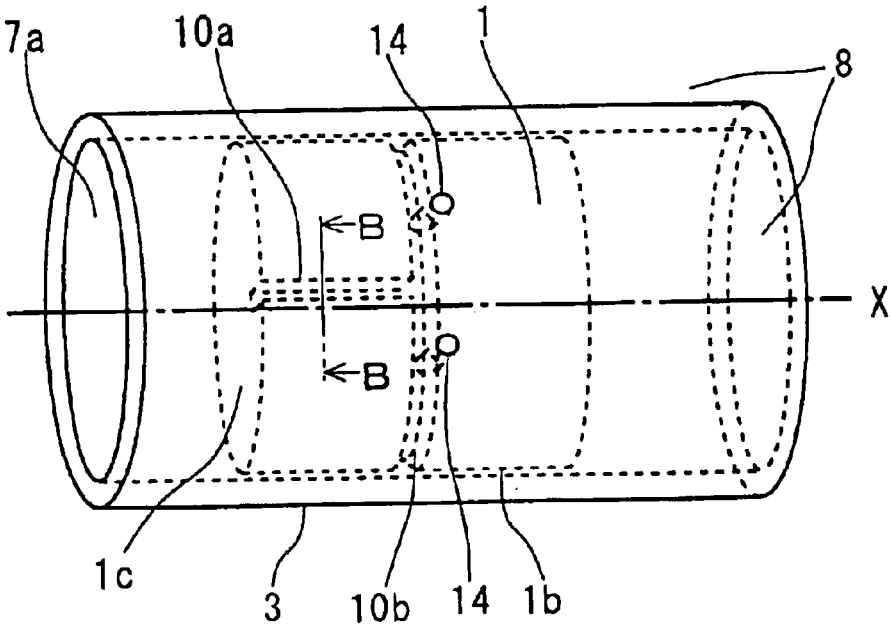
FIG. 7A is a perspective view of the piston and the cylinder of a seventh embodiment of the invention.
Figure 7B:
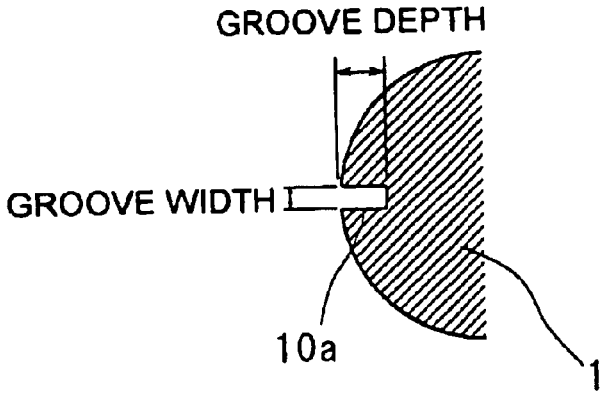
FIG. 7B is a sectional view taken along line B—B shown in FIG. 7A.

FIG. 7A is a perspective view of the piston and the cylinder of a seventh embodiment of the invention. The piston 1, the first and second grooves 10*a* and 10*b,* and the holes 14 are arranged in the same manner as in the second embodiment. FIG. 7B shows a sectional view taken along line B—B shown in FIG. 7A. The first groove 10*a* is so formed as to have a cross-sectional area required to permit the flow of the working medium and have a cross-sectional shape of which the depth is greater than the width. This helps reduce the area occupied by the first groove 10*a* relative to the surface area of the piston slide surface 1*b*. Thus, in a case where the piston 1 is kept floating off the cylinder 3 by means of an air bearing (a form of bearing realized by securing a very small clearance between the piston 1 and the cylinder 3 and filling the clearance with the working medium so as to reduce the sliding load of the piston 1), the working medium flows in and out through the first groove 10*a* and the effect of the air bearing is thereby maintained.

Figure 8:
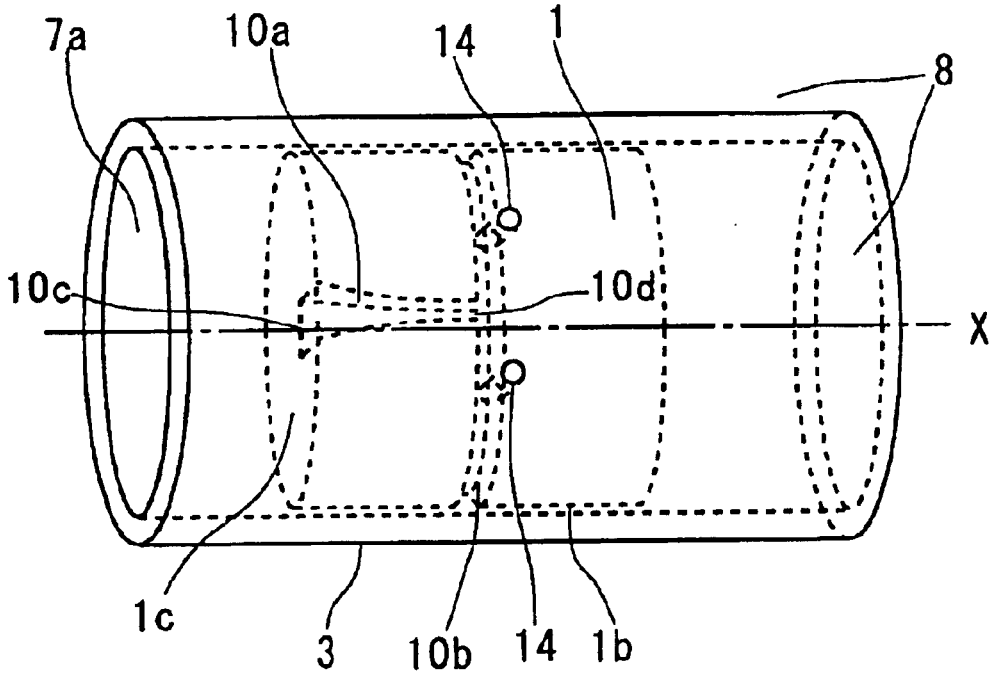
FIG. 8 is a perspective view of the piston and the cylinder of an eighth embodiment of the invention.

FIG. 8 is a perspective view of the piston and the cylinder of an eighth embodiment of the invention. The piston 1, the first and second grooves 10*a* and 10*b,* and the holes 14 are arranged in the same manner as in the fourth embodiment. The first groove 10*a* is so formed as to have increasingly large cross-sectional areas from one end 10*d* thereof toward the piston end surface 1*c* so that the first groove 10*a* has the maximum cross-sectional area at the other end 10*c* thereof facing the first space 7*a*. This helps reduce the energy loss due to the flow of the working medium.

Figure 9A:
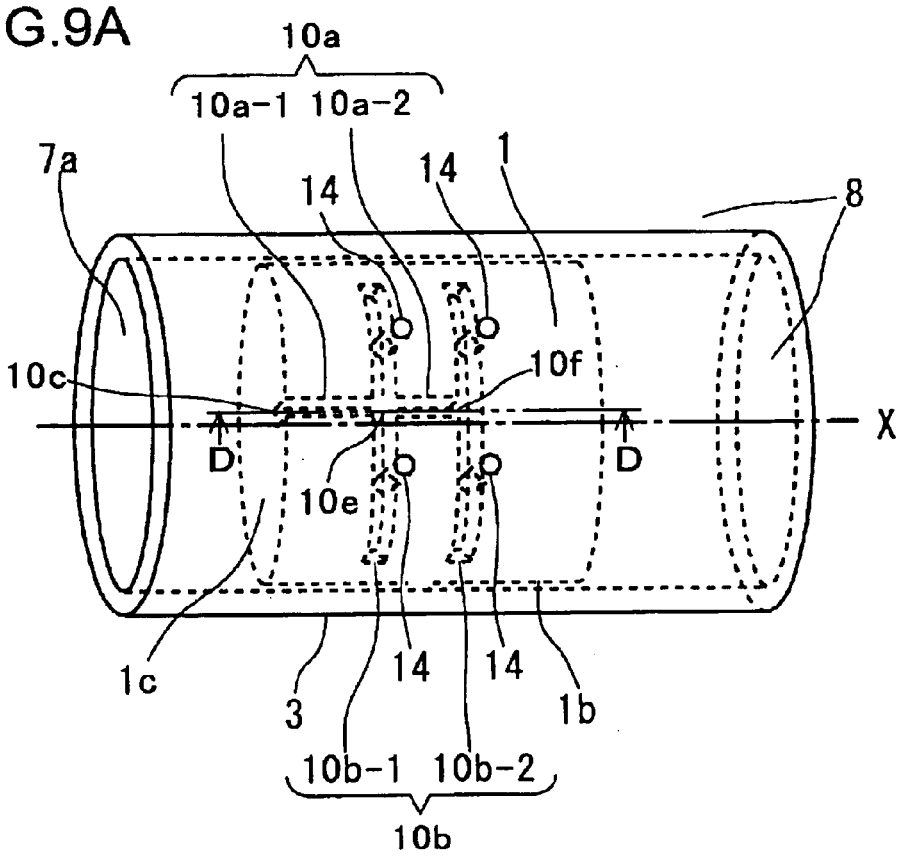
FIG. 9A is a perspective view of the piston and the cylinder of a ninth embodiment of the invention.
Figure 9B:
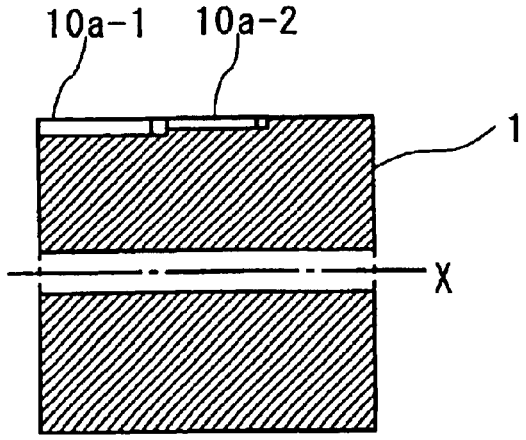
FIG. 9B is a sectional view taken along line D—D shown in FIG. 9A.

FIG. 9A is a perspective view of the piston and the cylinder of a ninth embodiment of the invention. The piston 1, the first and second grooves 10*a* and 10*b,* the holes 14 are arranged in the same manner as in the fifth embodiment. Here, the portion of the first groove 10*a* between one end 10*c* thereof facing the first space 7*a* and the root portion of the first 10*b*-1 of the second grooves as counted from the first space 7*a* side is referred to as the portion 10*a*-1, and the portion of the first groove 10*a* between the root portion of the first 10*b*-1 of the second grooves as counted from the first space 7*a* side and the root portion of the second 10*b*-2 of the second grooves as counted from the first space 7*a* side is referred to as the portion 10*a*-2. FIG. 9B is a sectional view taken along line D—D shown in FIG. 9A. As shown in FIG. 9B, the portion 10*a*-1 has a larger cross-sectional area than the portion 10*a*-2.

Specifically, the cross-sectional area of the second grooves 10*b*-1 and 10*b*-2 as measured along their shorter sides is made equal to the diametrical cross-sectional area of one hole 14, the cross-sectional area of the portion 10*a*-2 of the first groove as measured along their shorter sides is made equal to the total diametrical cross-sectional area of two holes 14*a,* and the cross-sectional area of the portion 10*a*-1 of the first groove as measured along their shorter sides is made equal to the total diametrical cross-sectional area of four holes 14*a.* This makes it possible to secure the minimum cross-sectional areas of the first and second grooves 10*a* and 10*b* so that, when the second grooves 10*b*-1 and 10*b*-2 communicate with the holes 14, the working medium can flow without pressure loss. In this way, it is possible to minimize the energy loss due to the flow of the working medium.

In any of the embodiments described above, the first and second grooves 10*a* and 10*b* can be formed, for example, by lathing or by milling using an end mill, and the holes can be formed by drilling alone. That is, the grooves and holes can both be formed easily and cheaply.

Industrial Applicability

In a Stirling-cycle engine according to the present invention, it is possible to shorten the time for which the first and second grooves formed on the piston and the holes formed in the side wall of the cylinder communicate with each other when the piston is driven to move, and thereby stabilize the center position of the reciprocating movement of the piston.

The first and second grooves and the holes are formed as grooves and holes that are easy to form, and can thus be formed cheaply.

Moreover, in a Stirling-cycle engine according to the present invention, the first and second grooves can be so formed as to have a cross-sectional area required to permit the flow of the working medium and have a cross-sectional shape of which the depth is greater than the width. Thus, in a case where the piston is kept floating off the cylinder by means of an air bearing, the working medium flows in and out through the first and grooves and the effect of the air bearing is thereby maintained.

Furthermore, in a Stirling-cycle engine according to the present invention, it is possible to secure the minimum cross-sectional area of the first and second grooves required to permit the flow of the working medium, and thereby minimize the gas flow loss that occurs as the working medium flows through the first and second grooves.

What is claimed is:

1. A Stirling-cycle engine comprising a piston that reciprocates inside a cylinder and a displacer that reciprocates inside the cylinder as a result of a working medium being compressed or expanded by the reciprocating movement of the piston, the piston and the displacer being arranged so that center axes thereof coincide with a center axis of the cylinder, the Stirling-cycle engine having a first space formed between the displacer and the piston, a second space formed so as to extend from a side of the piston facing away from the displacer and include a portion adjacent to at least part of a side wall of the cylinder, a third space formed on a side of the displacer facing away from the piston, a first groove formed so as to run from an end surface of the piston facing the first space in a direction of the reciprocating movement, and a second groove formed around a periphery of the piston so as to cross the first groove, and a hole formed through the side wall of the cylinder, the Stirling-cycle engine being so structured that, when the piston is in a center position of the reciprocating movement thereof, the second grove and the hole connect to each other so that the first and second spaces communicate with each other, wherein an opening of the hole has a shape of an elongate circle or a rectangle having a minor axis or shorter sides thereof aligned with the direction of the reciprocating movement of the piston.

2. A Stirling-cycle engine as claimed in claim 1, wherein the second groove is so formed that a depth thereof is greater than a width thereof as viewed in a cross section thereof.

3. A Stirling-cycle engine as claimed in claim 1, wherein the first groove is so formed that a depth thereof is greater than a width thereof as viewed in a cross section thereof.

4. A Stirling-cycle engine as claimed in claim 1, wherein the first groove has increasingly large cross-sectional areas from one end thereof toward another end thereof so that the first groove has a maximum cross-sectional area at the other end thereof facing the first space.

5. A Stirling-cycle engine comprising a piston that reciprocates inside a cylinder and a displacer that reciprocates inside the cylinder as a result of a working medium being compressed or expanded by the reciprocating movement of the piston, the piston and the displacer being arranged so that center axes thereof coincide with a center axis of the cylinder, the Stirling-cycle engine having a first space formed between the displacer and the piston, a second space formed so as to extend from a side of the piston facing away from the displacer and include a portion adjacent to at least part of a side wall of the cylinder, a third space formed on a side of the displacer facing away from the piston, a first groove formed so as to run from an end surface of the piston facing the first space in a direction of the reciprocating movement, and a second groove having a width formed on a periphery of the piston so as to cross the first groove, and a hole formed through the side wall of the cylinder, the Stirling-cycle engine being so structured that, when the piston is in a center position of the reciprocating movement thereof, the second grove and the hole connect to each other so that the first and second spaces communicate with each other, wherein the hole has an opening having a width greater than the width of said second groove.

6. A Stirling-cycle engine comprising a piston that reciprocates inside a cylinder and a displacer that reciprocates inside the cylinder as a result of a working medium being compressed or expanded by the reciprocating movement of the piston, the piston and the displacer being arranged so that center axes thereof coincide with a center axis of the cylinder, the Stirling-cycle engine having a first space formed between the displacer and the piston, a second space formed so as to extend from a side of the piston facing away from the displacer and include a portion adjacent to at least part of a side wall of the cylinder, a third space formed on a side of the displacer facing away from the piston, a first groove formed so as to run from an end surface of the piston facing the first space in a direction of the reciprocating movement, and a second groove formed around a periphery of the piston so as to cross the first groove, and a hole formed through the side wall of the cylinder, the Stirling-cycle engine being so structured that, when the piston is in a center position of the reciprocating movement thereof, the second grove and the hole connect to each other so that the first and second spaces communicate with each other, wherein the hole consists of a plurality of such holes arranged along the second groove.

7. A Stirling-cycle engine as claimed in claim 6, wherein the second groove is so formed that a depth thereof is greater than a width thereof as viewed in a cross section thereof.

8. A Stirling-cycle engine as claimed in claim 6, wherein the first groove is so formed that a depth thereof is greater than a width thereof as viewed in a cross section thereof.

9. A Stirling-cycle engine as claimed in claim 6, wherein the first groove has increasingly large cross-sectional areas from one end thereof toward the end surface of the piston so that the first groove has a maximum cross-sectional area at another end thereof facing the first space.

10. A Stirling-cycle engine comprising a piston that reciprocates inside a cylinder and a displacer that reciprocates inside the cylinder as a result of a working medium being compressed or expanded by the reciprocating movement of the piston, the piston and the displacer being arranged so that center axes thereof coincide with a center axis of the cylinder, the Stirling-cycle engine having a first space formed between the displacer and the piston, a second space formed so as to extend from a side of the piston facing away from the displacer and include a portion adjacent to at least part of a side wall of the cylinder, a third space formed on a side of the displacer facing away from the piston, a first groove formed so as to run from an end surface of the piston facing the first space in a direction of the reciprocating movement, and a second groove formed on a periphery of the piston so as to cross the first groove, and a hole formed through the side wall of the cylinder, the Stirling-cycle engine being so structured that, when the piston is in a center position of the reciprocating movement thereof, the second grove and the hole connect to each other so that the first and second spaces communicate with each other, wherein the hole comprises a plurality of holes arranged along the second groove.

* * * * *